United States Patent [19]

Hagiwara et al.

[11] Patent Number: 4,637,562

[45] Date of Patent: Jan. 20, 1987

[54] ROCKING SLAG BREAKER

[75] Inventors: Tatsuo Hagiwara, Funabashi; Keiji Imai, Ibaraki; Shigenori Nagaoka, Chiba, all of Japan

[73] Assignees: Kawasaki Jukogyo Kabushiki Kaisha; Ishii Syoji, Ltd., both of Japan

[21] Appl. No.: 688,889

[22] Filed: Jan. 4, 1985

[30] Foreign Application Priority Data

| | | | |
|---|---|---|---|
| Jan. 10, 1984 | [JP] | Japan | 59-2320 |
| May 28, 1984 | [JP] | Japan | 59-108104 |
| Nov. 9, 1984 | [JP] | Japan | 59-236470 |

[51] Int. Cl.[4] ..... B02C 1/10

[52] U.S. Cl. ..... 241/259.2; 241/268

[58] Field of Search ..... 241/32, 261, 264–269, 241/287–290, 296, 298, 259.2, 217, 218, 219, 204, 205, 206

[56] References Cited

U.S. PATENT DOCUMENTS

| | | | |
|---|---|---|---|
| Re. 25,799 | 6/1965 | Perdue | 241/291 |
| 605,704 | 6/1898 | Ebersole | 241/266 X |
| 1,142,116 | 6/1915 | Moyle | 241/291 X |
| 1,491,430 | 4/1924 | Stebbins | 241/266 |
| 3,918,648 | 11/1975 | Anthony | 241/32 |
| 3,976,255 | 8/1976 | Edwards | 241/264 |

FOREIGN PATENT DOCUMENTS

| | | | |
|---|---|---|---|
| 1276422 | 8/1968 | Fed. Rep. of Germany | 241/264 |
| 33047 | 9/1976 | Japan . | |
| 147416 | 12/1976 | Japan . | |
| 151615 | 12/1976 | Japan . | |
| 33163 | 3/1977 | Japan . | |
| 865835 | 4/1961 | United Kingdom | 241/291 |

*Primary Examiner*—Mark Rosenbaum

*Attorney, Agent, or Firm*—Leydig, Voit & Mayer

[57] ABSTRACT

A slag breaker for breaking slags from furnaces has a stationary breaker plate and a rocking breaker plate defining therebetween a breaking chamber and provided on the opposing surfaces thereof with undulations. The size of the outlet of the breaking chamber is about 1/5 to 2/5 of that of the inlet of the breaking chamber. The size of the outlet of the breaking chamber is internationally changed cyclically and incrementally, by the operation of a hydraulic mechanism which is equipped with a specific dust proof means.

4 Claims, 9 Drawing Figures

ROCKING SLAG BREAKER

BACKGROUND OF THE INVENTION

The present invention relates to a rocking slag breaker which can effectively break or deform various types of slags generated in iron- and steel-making processes and having a high iron content of 50 to 60% and large sizes ranging between 300 to 500 mm.

Conventionally, most of slags produced in blast furnaces, converters and electric furnaces used in iron- and steel-making processes have been disposed of. In recent years, however, there is an increasing demand for recovery of iron content of the slags and utilization of the slags as aggregates.

The recovery of the iron content is made by magnetically collecting the iron content from the slags in the course of braking of the slags and using the collected iron as the concentrates for making iron and steel. It has been proposed also to grind the slags by means of a rod mill or a self-generating crushing mill. Examples of such known techniques are shown in, for example, Japanese Patent Publication No. 33047/1976 and Japanese Patent Laid-Open Nos. 147416/1976, 151615/1976 and 33163/1977. These known arts are summarized as follows:

(1) The maximum size of the furnace slags treated is up to 300 mm, and does not exceed 500 mm even in special cases.

(2) In most cases, the furnace slags having sizes not greater than 300 mm and having high iron contents of 50 to 60% are used as the concentrates directly or after increase of the iron content up to 90% or higher by a grinding by a rod mill or a self-generating crushing mill.

(3) Furnace slags having small sizes not greater than 300 mm and small iron contents are subjected to crushing, magnetic sorting and sieving to separate slags having comparatively high iron contents. The separated slags are used directly as the concentrates or after a grinding by a rod mill or a self-generating crushing mill for higher iron content.

(4) Furnace slags of sizes greater than 500 mm are subjected to a sorting which is conducted through the aid of a lifting magnet or by visual check and only the slags having small iron content are subjected to breaking into sizes of less than 300 mm. The broken slags are then subjected to various processings.

(5) Furnace slags having sizes exceeding 300 mm and having large iron contents are stacked without any processing and are usually disposed of in the following ways:

(a) crushed by a weight of 2 to 5 tons (b) cut by means of gas flame (c) broken by dynamite after drilling (d) opened with many crossing apertures and broken by means of steel wedge bars.

The work of disposing of the bulky furnace slags greater than 300 mm and having high iron content requires human labour and is quite inefficient. In addition, the workers are subjected to danger due to scattering of small pieces of slags and fragments.

Under these circumstances, there is an increasing demand for furnace slag breaking machines capable of efficiently breaking slags down to sizes of less than 300 mm.

Under this circumstance, the present inventors have experimentally carried out a slag breaking method in which slags greater than 500 mm and rich in iron were broken by application of compressive force. The results of this experiment were as follows:

(1) In the case where the iron is contained as pig iron, such pig iron of iron content up to 100% was broken separated from the slag. The sizes of the slag pieces were concentrated to smaller side of the pig iron size distribution.

(2) In the case where the iron is contained as steel, the slags attaching to or wrapped by the steel were separated as a result of deformation of the steel. Defective parts such as those having internal cavities or blow holes or surface roughness, as well as thin-walled part of the steel, were broken and separated.

(3) As a result of the breaking mentioned in (1) and (2) above, the iron content of the slag was increased without exception to a level of 90% or higher at the greatest.

It has been accepted as a common understanding that metals in furnace slags cannot be broken. Such metals, however, are not homogeneous unlike steel sheets, cast steel and cast iron, but have many surface roughness and cracks, as well as internal defects such as cavities and blow holes. Therefore, when the metals in slags are compressed, stresses are concentrated at the defects so that the metals are easily broken by a comparatively small force.

The inventors have found also that, when the breaking compressive force is applied in the form of three-point bending in which forces of the same direction are applied to both ends of the slag while the central part of the same is subjected to a force acting in the opposite direction, the force required for the breaking is reduced almost to a half of that required for the breaking by a simple compression between two opposing surfaces. With the compression under the application of three-point bending, most of the bulky furnace slags of sizes above 300 to 500 mm could be broken or deformed into sizes below 300 to 500 mm.

SUMMARY OF THE INVENTION

Accordingly, an object of the invention is to provide a rocking slag breaker capable of efficiently breaking or deforming bulky furnace slags of large sizes greater than 300 to 500 mm.

Another object of the invention is to provide a rocking slag breaker in which the broken pieces of slags are efficiently discharged without stagnating in the breaker and in which the dust particles generated during the breaking do not impair the performance of the breaker.

To this end, according to one aspect of the invention, there is provided a rocking slag breaker for breaking slags generated in furnaces, having a stationary breaker plate and a rocking breaker plate which oppose each other to define a breaker chamber therebetween having an axis along which the slags move during the breaking operation, the breaker comprising: undulations formed on the opposing surfaces of the stationary and rocking breaker plates, each undulation consisting of crests and valleys appearing alternatingly in the direction perpendicular to the direction of movement of the slag such that each crest on one of the breaker plates opposes a corresponding valley in the other of the breaker plates, the undulation formed on one of the breaker plates having one to three crests while the undulation formed on the other of the breaker plates has two to four crests.

Other and further objects, features and advantages of the invention will appear more fully from the following description.

DESCRIPTION OF THE PREFERRED EMBODIMENTS

Figure 1:
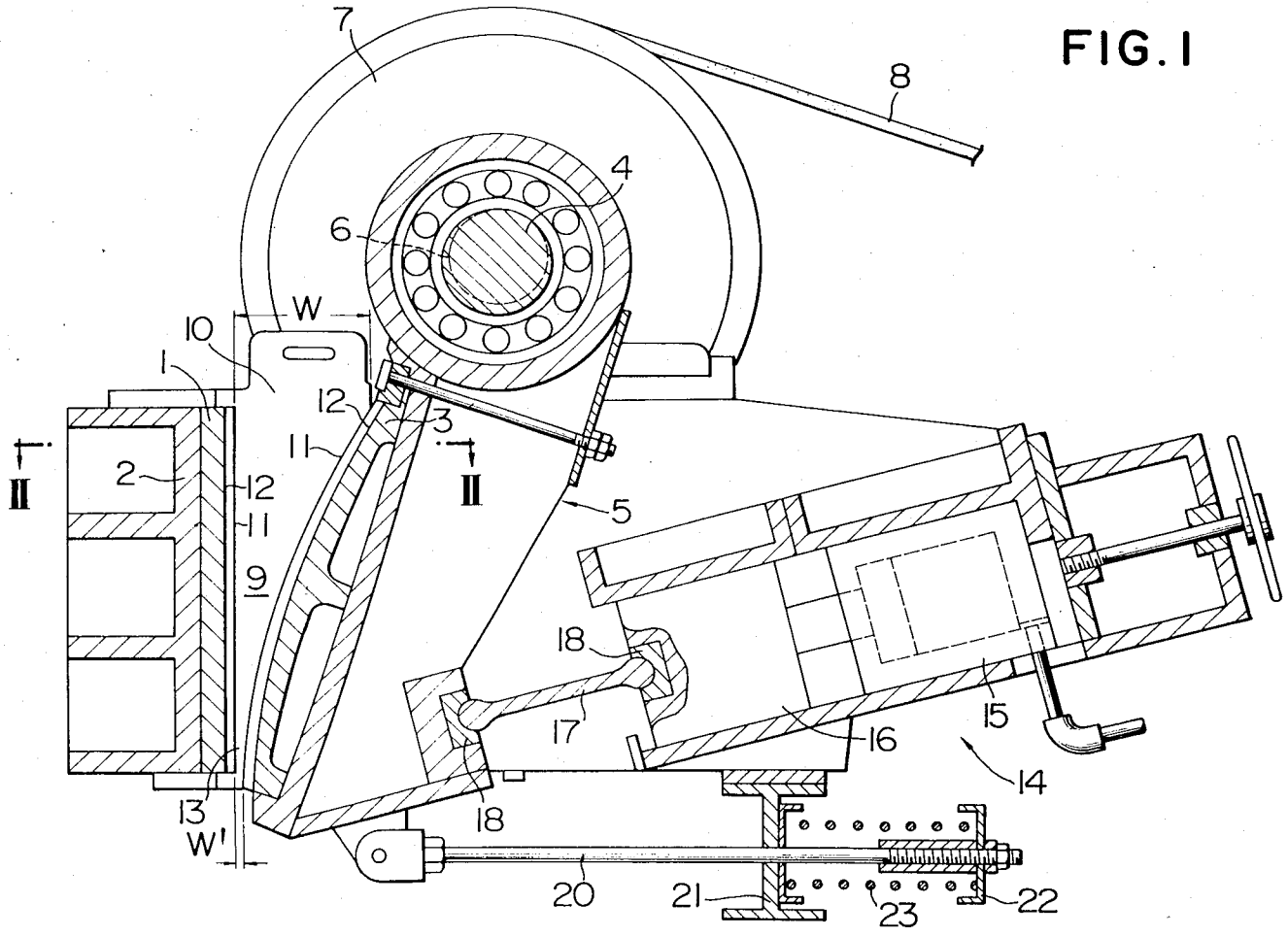
FIG. 1 is a rocking slag breaker in accordance with the invention.
Figure 2:
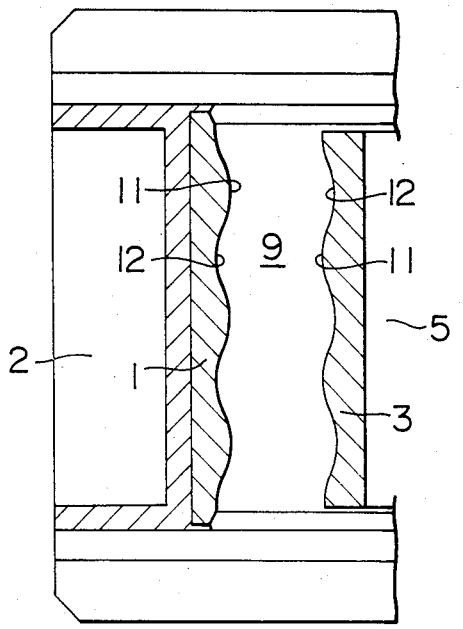
FIG. 2 is a sectional view taken along the line II—II of FIG. 1.

Referring to FIGS. 1 and 2, a stationary breaker plate 1 is vertically fixed to a left side wall of a casing 2, while a rocking breaker plate 3 is arranged to oppose the stationary breaker plate 1 at an inclination with respect to the stationary breaker plate. The rocking breaker plate 3 is fixed to a jaw 5 which is driven by an eccentric shaft 4 to rock up and down and back and forth. The jaw 5 is supported at its lower rear side by a hydraulic mechanism 14, through toggle seats 18 and a toggle plate 17. The hydraulic mechanism 14 has a hydraulic cylinder 15 and a slide block 16 fixed to a hydraulic piston received in the hydraulic cylinder 15.

A horizontal slide rod 20 is pivotally supported at its front end by the lower end of the swing jaw 5. The slide rod 20 slidably penetrates a base 21. A compression spring 23 loaded between the base 21 and a spring retainer 22 provided on the rear end of the slide rod 20. The compression spring 23 exerts a force which acts to press the toggle plate 17 to both toggle seats 18. The eccentric shaft 4 is connected at its one end directly to a drive shaft 6 having a pulley 7 which in turn is drivingly connected through a V-belt 8 to a pulley provided on the output shaft of an electric motor which is not shown. The stationary breaker plate 1 and the rocking breaker plate 3 in cooperation define a breaker chamber 9 therebetween. The function, construction and operation of the hydraulic mechanism 14 will be described later.

As will be seen from FIG. 2, the opposing surfaces of the stationary and rocking breaker plates 1 and 3, as viewed from an inlet 10 formed at the upper ends of these plates, are undulated in the breadthwise direction such that the crests 11 and valleys 12 oppose each other. More specifically, one of the breaker plates has one or more crests 11, while the other has a greater number of crests 11 by one. In the illustrated embodiment, the stationary breaker plate has three crests, while the rocking breaker plate 3 has four crests.

Since one of the breaker plate has one to three crests 11 while the other has two to four crests 11, the bulky slag S placed between these breaker plates are compressed in the form of three-point support. If the breaker plates have greater number of crests, the number of points of application of the force is increased to decrease the bending stress. More exactly, assuming a bulky slag having a size of $500\times750\times1000$ mm as the representative of the furnace slag greater than 300 to 500 mm, the inlet 10 of the breaker chamber 9 for receiving this slag typically has a length of 1500 mm and a width of 750 mm. This size is enough for receiving most of the bulky furnace slag.

Figure 3A:
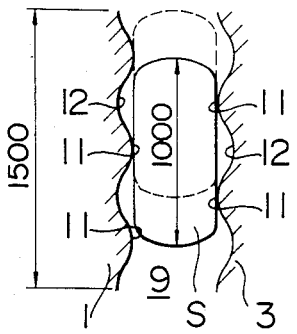
FIGS. 3*a*, 3*b* and 3*c* are illustrations of bulky furnace slags of different sizes during breaking by being pressed between a stationary breaker plate and a rocking breaker plate.
Figure 3B:
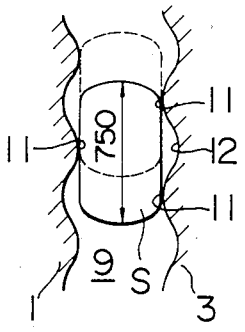
Figure 3C:
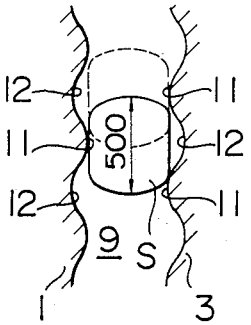

From FIGS. 3*a*, 3*b* and 3*c*, it will be understood that the combination of two crests and three crests is most ideal because the bending by compression between two breaker plates is applied most effectively in whatever posture the slag may be received in the breaking chamber. If a suitable means is provided to ensure that the slag is introduced into the breaking chamber such that the direction of its greatest sides of 1000 mm coincides with the depthwise direction or axis of the breaking chamber, the length L of the inlet 10 can be reduced down to 750 mm. In this case, a combination of two crests and three crests is enough for ensuring the breaking of the slag.

In the case where the bulky slags are expected to have smaller sizes, it is preferred that a combination of two crests and three crests is substituted by a combination of three crests and four crests. The use of greater number of crests, however, is not preferred because in such a case the state of compression approaches the state of simple compression between two planer breaker plates to decrease the effect of bending compression.

Although in FIGS. 3*a* to 3*b* the crests 11 have sine-wave form, this is not exclusive and the crest can have any desired form such as triangular form, trapezoidal form and so forth.

Preferably, the distance between the stationary breaker plate 1 and the rocking breaker plate 3 at the outlet 13 defined by the lower ends of these plates ranges between 1/5 and 2/5 of the distance between these two plates at the inlet 10, for the following reason.

Namely, the width W of the inlet 10 of the breaking chamber 9 is determined by the maximum size of the bulky slag to be fed, while the width W' of the outlet 13 depends on the ratio of breaking of the metals in the slag which requires a large force during the breaking. In general, it is said that the material having high compression strength has to be broken at a smaller breaking ratio. The inventors have conducted a test in which metals were broken by compression force. As a result, it was confirmed that most of the metals are broken or deformed and discharged smoothly provided that the width W' of the outlet 13 of the breaker chamber 9 is selected to be $(0.2 \text{ to } 0.4)\times W$, where W represents the width of the inlet 10. With this knowledge, the present invention proposes to select the width W' of the outlet chamber to be about 1/5 to 2/5 of the width of the inlet 10.

In the actual operation of the breaker, however, there is a fear that the bulky slag S is not securely caught in the breaker chamber 9 but is allowed to relieve upwardly from the chamber 9, when the rocking breaker plate is moved closer to the stationary breaker plate. In such a case, the slag S is not effectively compressed despite the rocking motion of the rocking breaker plate 3 but is allowed to stagnate for a long time in the breaker chamber 9. In such a case, it is necessary to temporarily stop the operation of the breaker and to lift and eject the slag S upwardly or to expand the outlet 13 of the breaker chamber 13 to allow the discharge of the unbroken slag to the lower side of the breaker. Consequently, the time length of effective operation of the breaker is shortened undesirably.

The hydraulic mechanism 14 mentioned before is provided for preventing this stagnation of the slag in the breaker. The operation of this hydraulic mechanism is as follows. As the hydraulic pressure is supplied to the cylinder chamber behind the piston, the piston and, hence, the toggle plate 17 connected thereto is driven forwardly, i.e., to the left as viewed in FIG. 1, thereby to reduce the size of the outlet of the breaker chamber.

To the contrary, by reducing the hydraulic pressure chamber behind the piston, the compression spring 23 acts on the lower end of the swing jaw 5 through the slide rod 20 so that the size of the outlet 13 is increased. Therefore, with the aid of control valves, position sensors and so forth, the hydraulic mechanism 14 can vary the width W' of the outlet in accordance with a predetermined plan.

Figure 7:
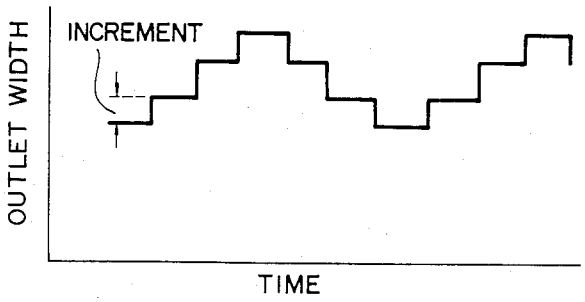
FIG. 7 is an illustration showing how the size of the outlet of a breaker chamber is changed.

The periodical driving of the lower end of the jaw 5 by the hydraulic mechanism 14 in a manner shown in FIG. 7 causes a change of the positions of the points of contact between the slag S and both breaker plates 1, 3 so that the effect of the bending compression explained before is maximized. From this point of view, according to the invention, the distance between two breaker plates at the outlet of the breaker chamber formed by the lower ends of the breaker plates are increased and decreased cyclically in a stepped manner. The increment or decrement of the outlet size in each step of operation is about 1/10 to 1/5 of the initial size of the outlet.

It is also preferred to limit the maximum hydraulic pressure because such a limit naturally limits the level of the reaction force produced by the slag and acting on the breaker plates, thus protecting the breaker from excessive force which would otherwise damage the breaker.

The reason why the increment or decrement of the stepped change in the size of the outlet at the lower end of the breaker chamber is selected to be 1/10 to 1/5 of the initial outlet size is as follows. Namely, the slags falls downwardly intermittently and progressively along the axis of the breaker chamber in accordance with the stepped change of the outlet size during the breaking, so that the positions of contact between the slags and the breaker plates are progressively changed as the breaking proceeds. If the above-mentioned increment or decrement is less than 1/10 of the initial outlet size, the distance of change of the contact points is too small. This merely increases the pressure-receiving area and does not produce any remarkable increase in the breaking effect. On the other hand, an increment or decrement in excess of 1/5 of the initial outlet size undesirably reduces the number of change of the contact positions before the slag leaves the breaker. This increases the time duration of stay of the slag at each position during the breaking operation, often resulting in an upward escape of the slag.

Attention must be drawn also to the fact that the slag breaker is usually used in an atmosphere which contains dusts generated during the breaking and deformation of the slags. The dusts therefore contain a large amount of fine powders of slags, as well as fine powders of metal, i.e., iron. The fine powders tend to come into the hydraulic mechanism to attach to the sliding surfaces on the piston and the cylinder, as well as to the sliding surfaces of the piston rod and the piston rod cover. The fine powders are mixed with the lubricating oil on these sliding surfaces to seriously impede the smooth operation of the piston. To avoid this problem, the hydraulic mechanism incorporated in the slag breaker of the invention has a means for preventing the powders from coming into the hydraulic mechanism, as will be understood from the following description with specific reference to FIGS. 4, 5 and 6.

Figure 4:
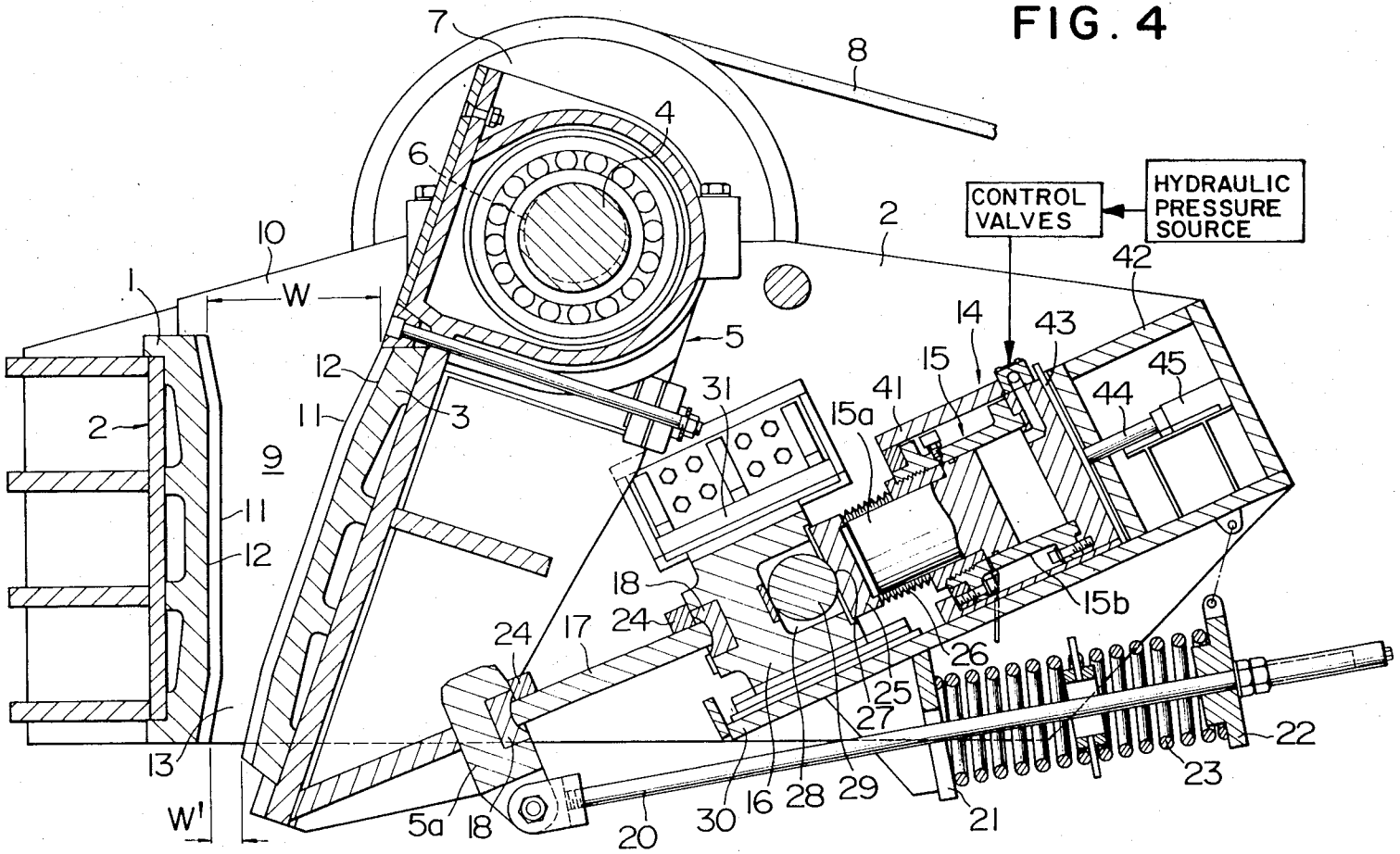
FIG. 4 is a vertical sectional view showing the detail of a hydraulic mechanism incorporated in the rocking slag breaker of the invention.

In FIG. 4, the same reference numerals are used to denote the same parts or members as those appearing in FIG. 1.

Referring to these figures, the hydraulic mechanism 14 incorporates a pair of hydraulic cylinders 15 arranged in a side-by-side fashion. Each hydraulic cylinder has a front chamber adapted to be supplied with atmospheric air and a rear chamber adapted to be supplied with pressurized oil. Each hydraulic cylinder 15 receives a piston rod **15*a* the end of which is connected to a slidable toggle block 16 and a toggle plate 17 interposed between the toggle block 16 and the lower rear side of the swing jaw 5. The front and rear ends of the toggle plate 17 contact with toggle seats 18 which are fixed to a fixing block 5*a* on the lower rear side of the swing jaw 5 and the toggle block 16, respectively. Dust covers 24 are attached to cover the upper side of the toggle plate 18 fixed to the block 5*a* and the upper side of the toggle seat 18 adjacent to the toggle block 16. A rod seat 25 is fixed to the end of the piston rod 15*a* of each hydraulic cylinder 15. A bellows 26 has one end fixed to the end of the cylinder tube 15*b* of the hydraulic cylinder 15 and the peripheral surface of the rod cylinder 25 so as to surround the piston rod 15*a*. Arcuate recess 27 is formed in the front surface of the rod seat 25 so as to fit a part of a rod 29 which is received in a recess 28 formed in the rear surface of the toggle block 16. The toggle block 16 is slidably supported between a support 30 provided on the casing 2 and a block retainer 31**.

Figure 5:
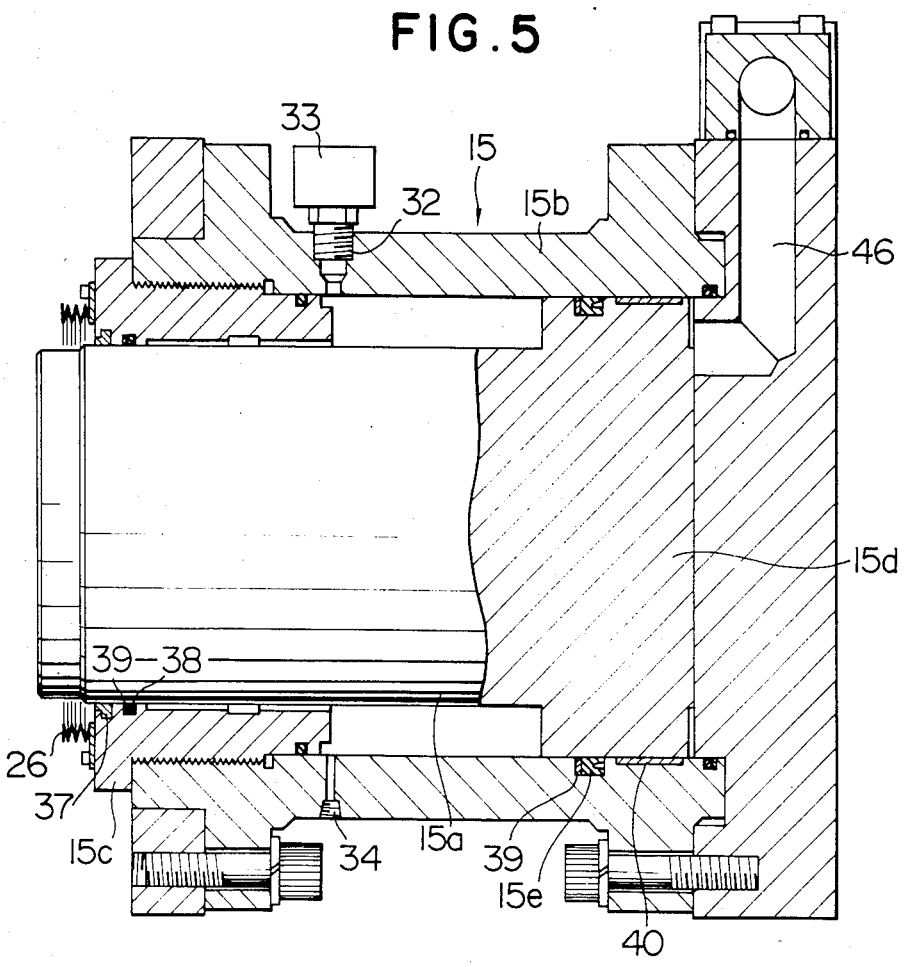
FIG. 5 is an enlarged vertical sectional view of a hydraulic cylinder shown in FIG. 4.
Figure 6:
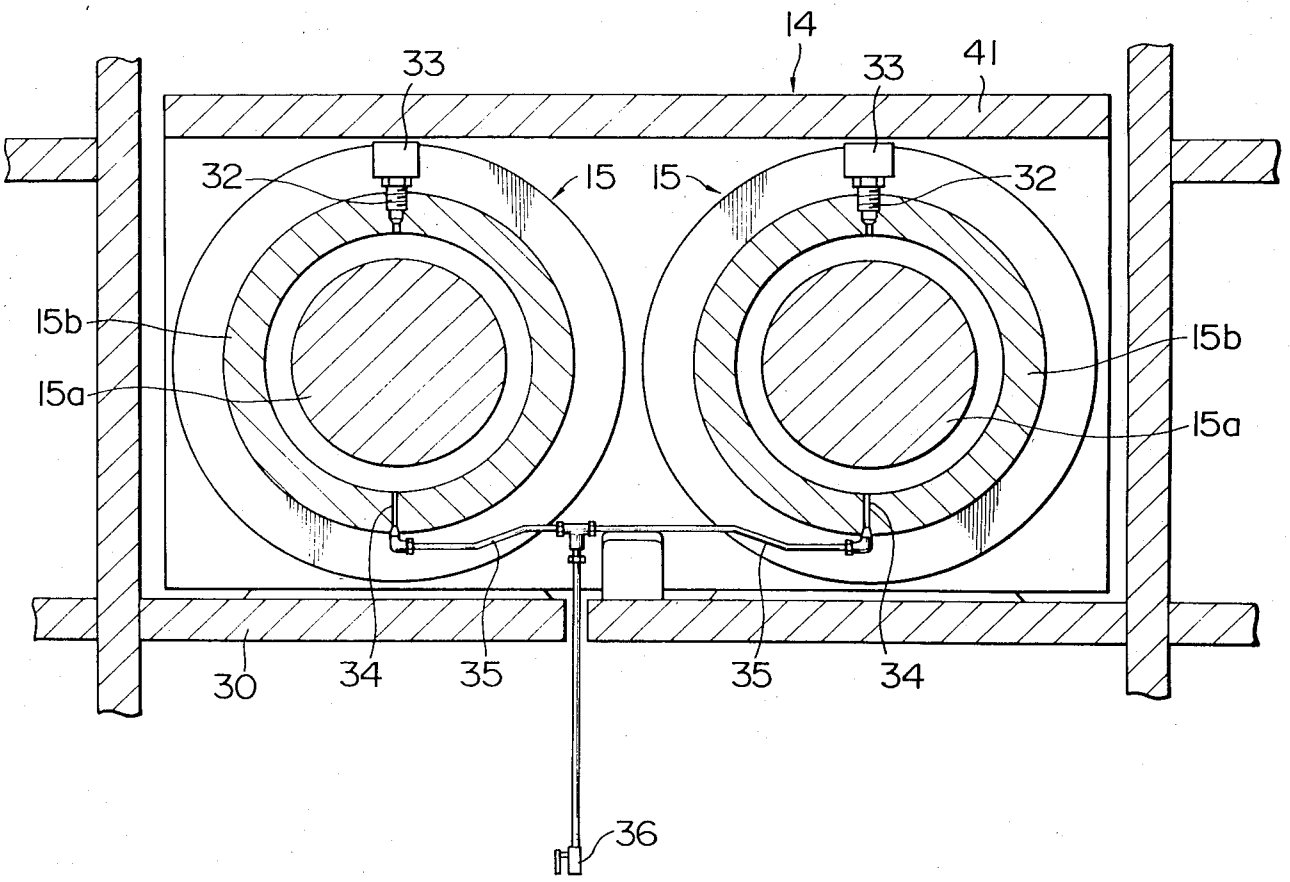
FIG. 6 is a cross-sectional view of a fore chamber of the hydraulic cylinder.

As will be seen from FIG. 5, the force chamber of the hydraulic cylinder 15 is adapted to be filled with air through a plug 32 provided with an air filter 33. A drain port 34 is provided at the lower side of the force chamber of the hydraulic cylinder 15. Pipes 35 are connected to the drain ports 34 of both hydraulic cylinders 15 and merge in a common pipe which leads to a peacock 36, as shown in FIG. 6. A dust seal 37, an "O" ring 38 and a backup ring 39 are fitted in the small annular space between the piston rod **15*a* of each hydraulic cylinder 15 and the rod cover 15*c* connected to the cylinder tube 15*b*. Similarly, a wear ring 40, seal ring 15*e* and a backup ring 39 are provided in the annular gap between the piston 15*d* and the cylinder tube 15*b* of each hydraulic cylinder 15**.

As will be understood from FIG. 4, each hydraulic cylinder 15 is supported between the support 30 and the cylinder retainer 41 for free adjustment of position. Namely, an adjusting plate 43 is interposed between the stationary frame 42 provided on the rear end of the support 30 and the rear end surface of the hydraulic cylinder 15, while an adjusting rod 44 for pressing the adjusting plate 43 is disposed in the stationary frame 42. The adjusting rod 44 is movable back and forth by the action of a hydraulic ram 45. It is, therefore, possible to adjust the position of the hydraulic cylinder 15 by placing an adjusting plate of a suitable thickness between the stationary frame 42 and the hydraulic cylinder 15 and moving the adjusting rod 44 back and forth by driving the hydraulic ram 45. In FIG. 5, a reference numeral 46 denotes a passage through which the pressurized oil is supplied to the rear chamber in the hydraulic cylinder 15.

In the operation of the slag breaker for breaking and deforming the slags, the hydraulic cylinders 15 of the hydraulic mechanism operate intermittently to extend and retract their piston rods 15*a*. However, the dusts and powders produced during the breaking do not come into the front chambers of the hydraulic cylinders 15 partly because the piston rods 15*a* are covered by the bellows 26 and partly because the annular gap between the piston rods 15*a* and the rod cover 15*c* are sealed by the dust seals 37, "O" rings 38 and the back-up rings 39. It is to be noted that dusts and powders suspended by the air coming into the fore chamber of each hydraulic cylinder is trapped by the air filter 33 provided in the plug 32 so that only the clean air is allowed to come into the fore chamber of each hydraulic cylinder, thus excluding dusts and powders. It is conceivable that a part of the pressurized oil in the rear chamber leaks into the front chamber through the small annular gap between the piston 15*d* and the cylinder tube 15*b*. This leaking oil, however, does not stay in the front chamber but escapes through the drain port 34 and the drain pipe 35 and is discharged as the peacock 36 is opened.

In consequence, the undesirable adhesion of the dust-oil mixture to the sliding surfaces of the piston rod 15*a* and the rod cover 15*c* is avoided.

The sucking and discharge of the air into and out of the front chamber, as well as the discharge of leaking oil out of the front chamber, is conducted smoothly so that the no compression of air and oil takes place in the front chamber during the forward stroking of the piston 15*d*. Therefore, the power of the hydraulic cylinder 15 is used only for the intended purpose, i.e., for the breaking or deformation of the bulky slags. That is, the wasting of power or energy is minimized. Furthermore, the piston can be retracted without substantial resistance because air can be sucked freely into the front chamber to avoid establishment of any vacuum in this chamber.

In the operation of the slag breaker of the invention, a furnace slag S of a size greater than 300 to 500 mm and having an iron content of above 50 to 60% is compressed between the stationary breaker plate 1 and the rocking breaker plate 3 which have undulated surfaces, and is effectively broken mainly by the bending load which is produced as a result of the compression. The broken pieces of the slag are smoothly discharged from the breaker chamber thanks to the cyclic and stepped change of the size of the breaker chamber outlet, so that the breaking capacity of the breaker is enhanced advantageously. Furthermore, by adopting a dust proof arrangement for the hydraulic mechanism for controlling the outlet size, troubles attributable to dusts is avoided to ensure a longer life of the breaker.

As has been described, according to the invention, it is possible to perform the breaking and deformation of the bulky furnace slag efficiently in quite a short period of time, so that the invention contributes an improvement in the recovery or collection of concentrates for further use in iron and steel making processes. The work as a whole can be conducted quite safely because the slags are broken or deformed without the dissipation of scattered slag and iron fragments.

Having described a specific embodiment of our invention, it is believed obvious that modification and variation of our invention is possible in light of the above teachings.

What is claimed is:

1. A rocking slag breaker for breaking slags generated in furnaces comprising a stationary breaker plate means and a rocking breaker plate means arranged to oppose said stationary breaker plate means at an inclination with respect thereto to define a breaker chamber therebetween having an axis along which slags move during the breaking operation between an inlet portion defined by the upper ends of said breaker plate mean and an oulet portion defined by the lower ends of said breaker plate means, said breaker plate means both having surfaces providing opposing undulations, each undulation including alternating crests and valleys in a direction substantially perpendicular to said axis such that each crest of one of the breaker plate means opposes a corresponding valley in the other of the breaker plates means and such that the number of crests on one of the breaker plate means corresponds to the number of valleys on the opposed breaker plate means, means for supporting said rocking breaker plate means for rocking movement, breaker plate drive means for imparting rocking movement to said rocking breaker plate means, and hydraulic means connected to said outlet portion of said breaker plate means operating independently of said breaker plate drive means to increase and decrease cyclically and incrementally the spacing between the lower ends of the breaker plate means where they define the outlet portion of the breaker chamber to allow the slags to fall downwardly intermittently and progressively along the axis of the breaker chamber in accordance with the incremental change in spacing and cause a change of points of contact between the slags and both breaker plate means to enhance compression of the slags therebetween and reduce stagnation in the breaker chamber.

2. A rocking slag breaker plate according to claim 1 wherein said hydraulic means has a limited hydraulic operating pressure so that said rocking breaker plate means is retractable when resisted by an excessive large reaction force produced by said slag.

3. A rocking slag breaker according to claim 2 wherein said hydraulic mechanism includes at least one hydraulic cylinder having a front chamber adapted to be filled with air and a rear chamber adapted to be charged with pressurized oil, a piston separating said front and rear chambers, a slidable toggle block connected to an end of a piston rod extending from said piston, and a toggle plate disposed between said toggle block and said swing jaw, said front chamber being provided with an air supply passage having an air filter and with a drain port connected through a drain pipe to a peacock, an annular gap defined between said piston rod and a rod cover, an annular gap between said piston and a cylinder of said hydraulic piston, and sealing means for said gaps including a dust seal, O-ring and a back-up ring.

4. A rocking slag breaker according to claim 1 wherein said hydraulic means increases and decreases the spacing between said lower ends of the breaker plate means where they define the outlet portion of the breaker chamber in increments selected to be no less than one-tenth of the spacing and no greater than one-fifth of the spacing of the lower ends.

* * * * *